US009447357B2

(12) United States Patent
Zozulya et al.

(10) Patent No.: US 9,447,357 B2
(45) Date of Patent: Sep. 20, 2016

(54) LUBRICATING COMPOSITION AND METHOD FOR THE PREPARATION THEREOF

(76) Inventors: Vladimir Leonidovich Zozulya, Kharkov (UA); Sergei Leonidovich Zozulya, Kharkov (UA); Sergei Nikolaevich Alexandrov, Kharkov (UA)

( * ) Notice: Subject to any disclaimer, the term of this patent is extended or adjusted under 35 U.S.C. 154(b) by 210 days.

(21) Appl. No.: 13/995,207

(22) PCT Filed: Nov. 16, 2011

(86) PCT No.: PCT/UA2011/000116

§ 371 (c)(1),
(2), (4) Date: Jun. 18, 2013

(87) PCT Pub. No.: WO2012/087260

PCT Pub. Date: Jun. 28, 2012

(65) Prior Publication Data

US 2013/0274157 A1 Oct. 17, 2013

(30) Foreign Application Priority Data

Dec. 24, 2010 (UA) ..... 201015684

(51) Int. Cl.

| | |
|---|---|
| ***C10M 125/00*** | (2006.01) |
| ***C10M 125/26*** | (2006.01) |
| ***C10M 125/10*** | (2006.01) |
| ***C10M 177/00*** | (2006.01) |

(52) U.S. Cl.

CPC ..... *C10M 125/26* (2013.01); *C10M 125/10* (2013.01); *C10M 177/00* (2013.01); *C10M 2201/062* (2013.01); *C10M 2201/105* (2013.01); *C10N 2210/01* (2013.01); *C10N 2210/02* (2013.01); *C10N 2210/03* (2013.01); *C10N 2210/08* (2013.01); *C10N 2230/06* (2013.01); *C10N 2280/00* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,229,309 | A * | 10/1980 | Cheng et al. | 508/391 |
| 5,409,622 | A | 4/1995 | Chapman et al. | |
| 5,840,666 | A | 11/1998 | Yokouchi et al. | |
| 6,423,669 | B1 * | 7/2002 | Alexandrov et al. | 508/161 |
| 2010/0055440 | A1 | 3/2010 | Lee | |

FOREIGN PATENT DOCUMENTS

| | | |
|---|---|---|
| GB | 499338 | 1/1939 |
| RU | 2057257 | 3/1996 |
| RU | 2059121 | 4/1996 |
| RU | 2168538 | 6/2001 |
| RU | 2168663 | 6/2001 |
| RU | 2233791 | 8/2004 |
| RU | 2269554 | 2/2006 |
| RU | 2356938 | 5/2009 |
| RU | 2364472 | 8/2009 |
| WO | 9640849 A1 | 12/1996 |

OTHER PUBLICATIONS

International Searching Authority (ISA/RU), International Search Report of the ISA, for PCT/UA2011/000116, Mailing Date Mar. 23, 2012, 1 page.

* cited by examiner

*Primary Examiner* — Taiwo Oladapo
(74) *Attorney, Agent, or Firm* — Beem Patent Law Firm

(57) ABSTRACT

The invention relates to lubricating compositions and methods for producing same. The lubricating composition comprises a lubricating medium and the product of dehydration of natural minerals or a mixture of natural minerals, or of synthesized hydrates.

The dehydration product contains the oxides MgO and/or SiO2 and/or Al2O3 and/or CaO and/or Fe2O3 and/or K2O and/or Na2O and has a particle size in a range of 100-100000 nm. The method for producing the lubricating composition comprises a step in which hydrates of metal and/or non-metal oxides are dehydrated at a temperature of from 300 to 1200° C., a step in which the dehydration product is stabilized by being kept at a temperature of from 700 to 1200° C. for a period of 1 to 3 hours, and a step in which the resultant product is mixed with a lubricating medium.

The resultant lubricating composition not only aids in reducing loads on friction surfaces, but also is capable of performing the function of strengthening friction surfaces as a result of the plastic deformation of the metal in nanovolumes and the surface layer being brought into an active nanostructured state, said surface layer thus being strengthened. At the same time, the grains of the metal undergo intensive fragmentation, the density of the grain boundaries is increased, and the conditions for the diffusion of carbon deep into the surface (vertically) and into the grains (horizontally) are improved.

2 Claims, No Drawings

LUBRICATING COMPOSITION AND METHOD FOR THE PREPARATION THEREOF

CROSS-REFERENCE TO RELATED APPLICATIONS

This application is a U.S. national stage application of PCT application PCT/UA2011/000116, filed Nov. 16, 2011, and claims the benefit of priority from Ukrainian Patent Application No. a 2010 15684, filed Dec. 24, 2010.

BACKGROUND OF THE INVENTION

The invention belongs to lubricating compounds and their preparation methods. Common knowledge includes numerous lubricant compounds, which can be applied for initial treatment of friction units of cars and mechanisms as well as for treatment during their operation, to extend time between overhauls or during maintenance and repairs.

Common knowledge includes a number of technical solutions aimed to solve similar engineering problems on friction reduction in friction units of cars and mechanisms, e.g.:

"Compound for the protective and antifriction surfaces formation on moving metal parts" (patent GB499338A), according to which the compound for the protective and antifriction surfaces formation on moving metal parts consists of zinc oxide, cadmium oxide, lubricating oil and vermiculite.

"Magnesium-containing dispersions" (U.S. Pat. No. 4,229,309A), according to which the process of preparing stable liquid of magnesium oxide containing dispersion is, essentially, in heating of the composition and includes energy-independent process liquid, containing Mg(OH)2 and dispersant agents of Mg(OH)2 dehydration temperature, where as long as there is non-dehydrated water, the above energy-independent process liquid can be heated to the Mg(OH)2 dehydration temperature, and the above dispersant agents can retain magnesium compounds, generated by dehydration in stable suspension.

"Lubricating compound and method" (application WO9640849A1), according to which lubricating compound contains super-absorbing polymers combined with the material to reduce friction between moving surfaces.

Common knowledge also comprises plenty lubricating compounds, which contain oxides of metals and non-metals, which in their stable phase contain oxides of magnesium (MgO), silicon (SiO2), aluminium (Al2O3), calcium (CaO), iron (Fe2O3), contained in the chemical compound of serpentine or talc.

Furthermore, the prior technical solution includes "Surface grease for objects contacting with water forms and method of its preparation" (U.S. Pat. No. 5,409,622), according to which the lubricant for local application on the surface of recreational equipment, designed for contacting with various forms of water to reduce friction between the abovesaid surfaces and abovementioned forms of water, the lubricating compound contains homogeneous mixture with at least 50% dispersed hexagonal boron nitride powder, water and the binding agent, selected from the group, consisting of cellulose, bentonite, hectorite, colloidal oxides, alkaline silicate and aluminium oxide, abovementioned aluminium oxide, obtained from the group, which is water-based colloidal aluminium oxide, peptized aluminium oxide and aluminium salt water solution, which can be transformed into the aluminium oxide by heating to the temperature of approx. 500-900° C.; this homogeneous mixture has the form of a paste. According to this technical solution, the lubricant compound is for the local application on the surface of recreational equipment, designed for contacting with various forms of water to reduce friction between the abovementioned surfaces and abovementioned forms of water, the abovestated lubricant body in the product is manufactured as follows: formation of homogeneous mixture of dispersed hexagonal powder boron nitride powder, water and the binding agent selected from the group, consisting of cellulose, bentonite, colloidal oxides, alkaline silicates, hectorites and aluminium oxide; this aluminium oxide, obtained from the group, which is water-based colloidal aluminium oxide, peptized aluminium oxide and aluminium salt water solution, which can be transformed into aluminium oxide which may be transformed into the aluminium oxide by heating to the temperature of approx. 500-900° C., formation of the abovementioned homogeneous mixture in the stated body; and drying this generated body to dehydrate it fully, the above dry body, contains hexagonal boron nitride ranging from 36 to 95 wt. %.

However, the technical solution, proposed under U.S. Pat. No. 5,409,622, has some drawbacks. Heating of water base of the colloidal aluminium oxide, peptized aluminium oxide and aluminium salt water solution to the temperature of 500-900° C. leads to bound water removal and crystal lattice destruction only, which insures removal only of hydroscopic moisture and water part, which is weakly bound in the crystal lattice. At the same time, as described above, provided a decay product penetrates, i.e. the product obtained in the result of thermal treatment in the range of 500-900° C., into the operating environment, e.g. lubricating compound, obtained product, assists in achieving only partial technical result, in particular, "lubricants for the local application to the surfaces of recreational equipment, designed for contacting with various water forms to reduce friction between the abovementioned surfaces and water forms".

Furthermore, it is common knowledge that compounds for friction pairs restoration, involving dehydration products of such hydrates, which in their stable form contain oxides, namely, MgO, SiO2, Al2O3, CaO, Fe2O3, K2 O, ONa2 ("Compound for the treatment of friction pairs and method of its preparation", U.S. Pat. No. 6,423,669). However, it was found that such compounds, as rule; at the same time do not contain all the oxides of those proposed under the oxide list in this technical solution.

For instance, a prior technical solution includes "Material for restoration of friction lining coupling" (patent of French Republic No. FR 2891333 dated 30 Mar. 2007), according to which friction lining couplings, including the material for restoration, at least partially, are coated with organic and inorganic hybrid material.

The common knowledge includes a technical solution, "Method of coating formation on friction surfaces" (patent of Russian Federation No. 2057257), which includes mechanical activation of finely dispersed mixture of minerals with the binding agent, placement of the obtained compound between the friction surfaces and its further run-in. In order to provide the diffusive penetration of the obtained coating into the friction parts surface the compound contains the mixture of minerals with dispersion 0.01-1.0 μm. Mechanical activation of the compound from the mixture of minerals and the binding agent is carried out by aperiodic fluctuations; at the same time the compound, placed between friction surfaces, contains (wt. %): mixture of minerals—3, 3; binding agent—96,7, ingredient content of the abovementioned compound is the following, (wt. %): SiO-30-40; MgO-20-35; Fe203-10-15; FeO-4-6; Al203-3-8; S-2-6; concomitant residual elements—5-30; therewith, run-in is carried out under the pressure of not less than 10 MPa and temperature in micro-volumes not less than least 300° C.

The common knowledge includes a technical solution, "Method of servovite film formation on friction surfaces" (patent of Russian Federation No. 2059121 dated 27 Apr. 1996), where in order to improve the quality of the servovite film, which is achieved by contacting the element of the treated friction pair of higher or equitable hardness, in friction pairs of varied hardness, activated mixture is placed between them; this activated mixture contains the following ingredients, weight: abrasive-like powder of natural serpentinite 0.5-40, sulphur 0.1-5, surfactant 1-40, organic binding agent—the rest; at the same time, the treated pair element is magnetized and connected to the negative pole of the direct current source, while the technological part is connected to the positive pole. Both parts are run-in till the servovite film formation, after that the technological part is replaced with a pair element and is run-in in the same mixture.

However, the technical solution proposed under patent of Russian Federation No. 2059121 dated 27 Apr. 1996 has a number of substantial drawbacks. The main ingredient of the proposed compound is natural serpentinite of the Pechenga deposit, made in the following way. First, this natural serpentinite was dispersed to 500 μm and finer, then it was separated through the metal screen at the angle of 7° to the horizontal plane with the frequency of 50 Hz and fluctuation range of 2.5 mm at the angle of 30° to the horizontal plane with and with the mesh of 200 μm, ensuring clarification and particle size of up to 40 μm. After that it was redispersed to the size of up to 5 μm, separated with a permanent magnet, which contributed to clarification increase and grinding to 2 μm.

As it is evident from the description of the preparation method of the main ingredient—serpentinite, the nanostructure production process includes mechanical and magnetic impact on the natural mineral, which according to the Authors of this technical solution leads to the possibility of achieving the size of the nanostructure from 5 to 2 μm (5,000-2,000 n.m.). The Authors of this technical solution do not use interdependent temperature and time hold of the natural mineral, which does not allow to obtain the size of the nanostructure below 2,000 n.m. and what is more, it does not allow to achieve irreversible phase of the grain structure, which, eventually, leads to the fact that being promoted by natural characteristics of crystal lattice and by entering into the medium, e.g.—lubricant, due to the reverse water intake from the environment, serpentinite forms solid, indefinite\chaotic shaped masses, which act as abrasive materials under operational loads, and during friction surfaces operation this leads to the effect opposite to the restoration of friction surfaces.

The common knowledge includes a technical solution "Triboceramic compound" (US application No. 2010184585), according to which a triboceramic coating contains the oxides of—magnesium oxide (MgO), silicon oxide (SiO2), aluminium oxide (Al2O3), calcium oxide (CaO), ferrous oxide (Fe2O3), contained in the chemical composition of the serpentinite and talc, characterized by the fact that in order to expand the field of application, natural and/or synthesized non-heat-treated and/or dehydrated minerals—serpentine, talc, clinochlore, magnesite, quartz and hydro-aluminium oxide will be introduced into the triboceramic compound, ensuring the formation of the following triboceramic compound, wt. %: SiO2-46-54, MgO-26-32, Al2O3-2-5, Fe2O3-1.0-1.5, CaO-0.1-0.3, H2O-5 or less.

The common knowledge includes a technical solution "Additives for introduction to the fuel of mechanisms, additive application and treatment processes for mechanisms operating parts" (patent of Federal Republic of Germany DE102004058276 (WO2006058768), according to which "additives" are added to the lubricant or fuel of the internal combustion engine. Hereinafter, additives are applied to the lubricant and fuel, intended for the internal combustion engine. The technical solution proposed under patent DE102004058276 (WO 2006058768) includes iron magnesium hydroxide silicate. Furthermore, it contains such especially active components as silicate polymers and/or metal hydrosilicates (silicates), man-made or natural, consisting of one or several silicates of silicon-oxygen crystal lattice, in fibre, stripe, multilayer or tubular structures, in particular, reflected in formula ((MglFe)3K [Si2K O5k] (OH)4Jn c k=1 up to 5, n=1 up to 10,000,000).

The Authors of the proposed technical solution believe that it is preferable to use serpentine according to chemical formula Mg6 [Si4 O10] (OH)8 and/or talc according to chemical formula Mg3[Si4O-io](OH)2. Magnesium sodium hydroxide silicate is used according to chemical formula Na2 Mg4 Si6 O-i[beta] (OH)2 by additional or alternative efficient designing of additives.

According to this technical solution, surfaces with the ceramic-metal coating (i.e. surfaces treated with the compound under this patent) are characterized by high corrosion resistance, notable through increased electric resistance of surfaces, high temperature stability (temperature of coating destruction is approx. 1,600° C.), microhardness, increased by 30 percent, as well as high pressure stability—up to 2,500 $N/mm^2$ under contact compression strain.

However, the serpentine (Mg6[Si4O10](OH)8) and/or talc (Mg3[Si4O-io](OH)2) application leads to the opposite effect.

The closest to the proposed technical solution to its technical matter and proposed technical result, is the "Compound for the treatment of friction pairs and its preparation" (U.S. Pat. No. 6,423,669), according to which the compound for friction pairs treatment includes oxides of metals and non-metals. The compound contains the products of hydrates dehydration with the temperature of bound water removal and crystal lattice destruction in the range of 400-900° C. as abovementioned oxides, which in their stable phase contain oxides from the range MgO, SiO2, Al2O3, CaO, Fe2O3, K2O, Na2O.

The proposed technical solution refers to the composition of consistent lubricant compound, in particular, to the compound for friction pairs restoration, and can be applied in machine-building industry for friction units treatment. The proposed invention is in improving of the compound for friction pairs restoration. In this compound products of hydrates dehydration, which in stable phase contain oxides from the range MgO, SiO2, Al2O3, CaO, Fe2O3, K2O, ONa2 are applied. Formation of the stable compound condition is carried out by the structures of nanodisperse oxides, which minimize resistance to movement, friction pairs surface contact area and transfer in any form of the friction into the rolling friction, and therefore, friction pair surface is strengthened and friction coefficient is increased.

However, the proposed technical solution has some considerable drawbacks. Temperature conditions for bound water removal and crystal lattice destruction are in the range of 400-900° C., which ensures the removal of only hydroscopic moisture and water part, which is weakly bound in the crystal lattice, as well as the removal of chemically bound water; herewith, increase of heat setting and porosity, reduction of source material density and destruction of covalent links between layers are observed in the obtained decay products. Provided the decay product, i.e. the product obtained as a result of thermal treatment ranging within 400-900° C., enters into the operating environment, e.g. lubricating compound which normally consists of numerous "oil-based" components and various additives, there is the formation of compounds, which under the interaction with the operating environment (oil base+additives), due to the reverse water intake from the operating environment, form solid, indefinite-shape and/or chaotic shape formations, which under the operational loads in the units in or friction surfaces work as abrasive agent, i.e. have the opposite effect and increase the wear of the friction surface, create "scuffs," "scratches" and reduce overhaul period of friction.

The basis of the proposed technical solution, is in the objective to obtain the lubricating compound, which, according to the invention, includes lubricant medium and natural mineral or natural mineral mix or synthesized hydrate dehydration product, where the dehydration product includes the oxides of MgO and/or SiO2 and/or Al2O3 and/or CaO and/or Fe2O3 and/or K2O and/or Na2O, obtained after bound water removal and crystal lattice at the temperature destruction from 400 to 900° C., Due to the fact that, in this compound dehydration product is obtained after bound water removal and crystal lattice destruction at up to 900° C., and achieves stable and/or irreversible phase at the temperature hold at 900-1,200° C., which ensures achieving nanostructure of the dehydration product within the range of 100-100,000 n.m.

Under the interaction of the proposed the lubricating compound with the surface materials, coating modification takes place, which may be described as the formation of ceramic-metal coating mostly consisting of metal carbides. As a result of experimental studies it was found that the lubricating compound provides the effect of mechanical interaction of nanoformations, obtained after decomposition of metal oxides, with the metal surface.

Technical effect, revealed under the lubricating compound application, is based on the fact that the original size of the revitalizant nanoformations is comparable with the size of surface defects (grainy texture, microroughness). This interaction leads to plastic flow of metal in nano-volumes and transition into the active nano-structured state of the surface layer. At the same time, intensive metal grain grinding occurs, the density of their boundaries is increased, the conditions for the diffusion of carbon into the surface (vertically) and into grains (horizontally) are improved.

Providing complex implementation of the proposed technical solution (compound and its preparation method), the Authors use the effect of bound water removal from some natural minerals, which, as it is well known can be constitutional, crystallization, zeolite and adsorption water. It is common knowledge that bound water is in the crystal lattice of the mineral as ions OH1−, less often H1+ and oxonium H3O1+. It is also known that it transits to the molecular state only under the mineral structure destruction, under heating, where separation of the bound water in each mineral is within the defined temperature range from 300° C. to 900° C.

Furthermore, the Authors of this technical solution, took into consideration the effect of hydrate moisture removal, i.e. the moisture, which is chemically bound with mineral admixtures and creates crystalline hydrates Al2O32SiO2-2H2O, Fe2O3-2SiO2-2H2O, CaSO4-2H2O, MgSO4-2H2O and others. This moisture escaped only under heating to the temperature of a least 600° C., volatile remnants of hydrate moisture are fully removed only under the temperature hold. Therefore, it was experimentally found that the temperature range of 400-900° C., without time hold is insufficient to remove volatile remnants of the hydrate moisture from dehydration products, which include e.g. the mixture of oxides: MgO and/or SiO2 and/or Al2O3. Consequently, the Authors found out that the removal of the volatile remnants of the hydrate moisture and obtaining irreversible state of the dehydration products, which contain the set of oxides MgO and/or SiO2 and/or Al2O3 and/or CaO and/or Fe2O3 and/or K2O and/or Na2O, is possible under higher temperatures, namely from 900 to 1,200° C.

DETAILED DESCRIPTION

The inventive step of the proposed lubricating compound is in the following.

The common knowledge includes lubricating compounds for friction pairs treatment (U.S. Pat. No. 6,423,669), which contain the oxides of metals and non-metals, which contain hydrate dehydration products with the temperature of the bound water removal and the crystal lattice destruction in the range of 400-900° C. as abovementioned oxides, which in their stable phase contain the oxides of series MgO, SiO2, Al2O3, CaO, Fe2O3, K2O, Na2O. Under the aforesaid temperature conditions (400° C.-900° C.) hydroscopic moisture and water part removal takes place, which is weakly bound in the crystal lattice, as well as removal of chemically bound water in the crystal lattice. Furthermore, increase of heat setting and porosity, reduction of source material density and destruction of covalent links between layers are observed.

However, the proposed temperature range promotes formation of compounds, which in case of penetrating into the medium, e.g.—lubricant, due to their reversible water intake from the environment form solid, indefinite\chaotic-shaped formations, which work as abrasive agents under operational loads.

For example, according to technical solution "Additives for introduction to the fuel of mechanisms, additive application and treatment processes for mechanisms operating parts (patent of Federal Republic of Germany DE102004058276 (WO2006058768), suggests that "Additives", containing iron magnesium hydroxide silicate, preferably serpentine (Mg6[Si4O10](OH)8) and/or talc (Mg3[Si4O-io](OH)2), form ceramic-metal coating with the coating destruction thermal stability approx. 1,600° C., i.e. actually temperature conditions of the coating formation is in the same range: approx. 1,600° C.

However, the drawback of the proposed technical solution is in the fact that material ("Additive") for ceramic-metal coating formation, which contains iron magnesium hydroxide silicate, preferably serpentine (Mg6[Si4O10](OH)8) and/or talc (Mg3[Si4O-io](OH)2), actually undergoes final heat treatment directly in the friction units during operation, which does not allow to form decay "stable particles" (serpentine (Mg6[Si4O10](OH)8) and/or talc (Mg3[Si4O-io](OH)2)), and the formation of these particles occurs chaotically during interaction between the friction surfaces, which eventually leads to the formation of particles (nanoformations) uncontrollable in size, and the formation of "tear", scratches and other defects.

Thus, according to the proposed technical solution, a lubricating compound containing decay products of metal and non-metal oxides at the temperature of dehydration 300-900° C. and the temperature of stabilization 700-1,200° C., due to the destruction of covalent links inside a layer \plate of the source material (decay products of metal and non-metal oxides) and the reaction of mullite formation, amorphous nanoformations or nanostructures are obtained, e.g.: amorphous aluminium silicate, which owing to the destroyed inner-layer links, not only transit to the irreversible state, i.e. they are unable to intake water molecules from the environment (oil, lubricating material or another medium), and also as a result of friction surfaces interaction, they are able to form new nanoformations (rolling forms), which leads not only to friction reduction in friction zones, but also to the restoration of friction surfaces or friction units during their operation.

Obtained nanoformations possess stable amorphous pomegranate-like form with size, which is within the range of 100-100,000 n.m, and the stable form formation of these nanoformations includes the stage of obtaining structurally irreversible form (stabilization stage), including dehydration product stabilization at 700-1,200° C. over 1-3 hours, under which the revitalizant nanostructure stabilizes within the range from 100 to 100,000 n.m. and the stage of achieving stable geometric shape (rolling form), which occurs after the stabilized dehydration product introduction to the friction surface or the friction area and depends on lubrication or friction conditions, under which: $h \leq Ra \leq$the size of stabilized revitalizant nanostructure, where h is the thickness of the lubricating layer or the distance between friction surfaces, Ra is the surface roughness.

The technical solution is also aimed at improving of the preparation method of the lubricating compound.

The common knowledge includes "Compound for the friction pairs treatment and its preparation method" (U.S. Pat. No. 6,423,669), according to which "the method of lubricating compound preparation" includes heating of hydrates of metal and non-metal oxides at the dehydration temperature within the range of 400-900° C. for the time sufficient to obtain stable dehydration product of the above oxide hydrate and blending of the abovementioned product with the lubricating medium to manufacture the lubricating compound, where the aforesaid oxides were selected from the group, consisting of MgO, SiO2, Al2O3, CaO, Fe2O3, K2O, or Na2O.

However, the drawback of the proposed method is the temperature conditions of "heating of hydrates of metal and non-metal oxides at the temperature of dehydration within the range of 400-900° C.". The Authors of the claimed technical solution believe that, proposed temperature conditions from 400 to 900° C., under any hold time will not lead to obtaining of formations stable to irreversible hydrate state, which, eventually, due to the reverse water intake from the operational environment, will lead to formation of solid, indefinite and/or chaotic-shaped conglomerates, which under the operational loads in friction units and surfaces work as abrasive agents, i.e. have the opposite effect and increase the wear of the friction surface and reduce overhaul period of friction units.

The aim of the proposed technical solution is improvement of the preparation method of the lubricating compound, allowing obtaining tribotechnical compounds, able not only to temporarily reduce friction ratio and restore damaged or worn surfaces but also maintain set technical features over the whole overhaul period.

According to the claimed technical solution, the proposed method includes the stage of dehydration of oxides hydrates of metals and/or non-metals at 300-1,200° C., the stage of mixing of obtained product with lubricating medium, where the abovementioned oxides are selected from the groups that include MgO and/or SiO2 and/or Al2O3 and/or CaO and/or Fe2O3 and/or K2O and/or Na2O, where, according to the invention, the method also includes the stage of the dehydration or decay product stabilization, which is implemented after dehydration or decay and which is implemented by the agreed temperature hold from 700 to 1,200° C. and time hold from 1 to 3 hours; at the same time, it solves the technical problem of obtaining the lubricating compound, providing not only reduction of loads on the friction surfaces. Furthermore, the obtained lubricating compound can strengthen friction surfaces due to plastic metal deformation in nanovolumes and transition of the surface layer, being strengthened, to the active nano-structured state. At the same time the intensive metal grain grinding takes place, density of their boundaries are increased, the conditions for the diffusion of carbon into the surface (vertically) and into grains (horizontally) are improved.

Technical effect of the proposed method is based on the formation of the stable form of nanoformations of the lubricating compound, obtained not only by bound water removal, dehydration of hydrates of series MgO and/or SiO2 and/or Al2O3 and/or CaO and/or Fe2O3 and/or K2O and/or Na2O, at 300-900° C., and also due to the temperature and time hold of the decay products and obtaining the decay product based on them, i.e. irreversible form of the revitalizant nanostructure (lubricating compound), whose obtaining is not only by bound water removal at 300-900° C., but also due to the fact that the obtained dehydration product is stabilized at 700-1,200° C. Hardness of nanoparticles comprises approximately 7-10 units on the Mohs scale.

For instance, it was found out that the bound water removal by dehydration of hydrates from series MgO and/or SiO2 and/or Al2O3 and/or CaO and/or Fe2O3 and/or K2O and/or Na2O, is not only a complex physical-chemical process but also an unstable and non-homogeneous process. Claimants have determined that the dehydration temperature conditions are 300-900° C. and stabilization temperature conditions are 700-1,200° C. for the hydrates from MgO and/or SiO2 and/or Al2O3 and/or CaO and/or Fe2O3 and/or K2O and/or Na2O, have transitional condition (period\state), which is approx. 700-900° C., or the condition of partial stabilization that often leads to the opposite effect, that means obtained nanoformations do not have stable form and the size of the formed conglomerates may exceed 100,000 n.m., and providing these formations get into the friction area there will be unstable tribotechnical effect, or the so-called "temporary effect".

Using, e.g. thermogravimetric research method it has been determined that the loss of weight under heating in some hydrates out of MgO and/or SiO2 and/or Al2O3 and/or CaO and/or Fe2O3 and/or K2O and/or Na2O, at the temperature of 300-700° C., is about 32-10 ΔH, mm, and it significantly reduces though also occurs at the temperature above 700° C. and is approx. 2-1 ΔH, mm., where ΔH, mm, proportionate Δ weight, and is stable.

In the actual application partial stabilization of nanoformations works as follows. By the lubricating compound application, that is provided non-stabilized form of nanoformations enters the friction area or surface, it is possible to obtain the friction coefficient reduction effect, which can last for some time under the stable and normal operation mode. However, when the friction surface is simultaneously affected by excessive and uneven loads, and after that the friction surface is run in normal operation mode, the achieved reduction of the friction coefficient disappears and sharp friction increase takes place leading to the opposite effect.

For instance, according to the technical solution (patent of Federal Republic of Germany DE102004058276 (WO2006058768), ceramic-metal coating is formed with temperature stability to approx. 1,600° C., that means that actual temperature conditions of forming the coating are within the same range (approx. 1,600° C.).

However, actually, thermal influence on particles (serpentine (Mg6[Si4O10](OH)8) and/or talc (Mg3[Si4O-io](OH)2)), takes place in the chaotic and non-systematic temperature and time conditions, which eventually, leads to generating of nanoformations that are uncontrollable in terms of their size, composition (structural pattern of the particle), which influences particles microhardness and disables stable participation in coating formation on the friction surface, which results in the formation of "scuffing", scratches and other defects.

Thus, according to the proposed technical solution, revitalizant nanoparticles, stabilized at 700-1,200° C., are not only the material to form the surface in friction units, besides act as pressure concentrators.

As an abbreviated original technical term "Lubricating compound for friction units restoration", the Claimant uses name—the "revitalizant", which has been used by XADO company (Ukraine, Kharkiv) since 1998, whereas the process of friction units or friction surfaces restoration is respectively called revitalization. The claimed technical solution, refers to the lubricating compound ("revitalizant") and its preparation method, as well as to the forms of its practical application, namely, to the revitalization process. In technical meaning or sense, the revitalizant and revitalization stand for the compound, activating or restoring the original technical parameters or features of friction surfaces or units and the method of this compound application or use for achievement of the expected technical result.

Pressure of the revitalizant particles in the places of contact with the surface reaches high values since its value is inversely proportional to the square of the particle size (2-2000 nm), i.e. in the nano-structured state the revitalizant forms specific P and T conditions (P is pressure, T is temperature) for the intensive diffusion of carbon atoms into the surface. These conditions determine easy formation of carbides from the solution of carbon in iron (low-temperature carbidization). This interaction is possible owing to the revitalizant nano-size.

Below are given samples of the lubricating compound application and its preparation method, according to the claimed invention.

An Example of Obtaining and Application of Lubricating Compound No. 1.

Lubricating compound No. 1 was applied for the treatment of the petrol engine with the power of 85 kW of automobile Mazda 626 2.0, manufactured in 2001, with 181,660 km of run, engine oil with viscosity SAE 10W-40 under SAE J300 standard and the level of ACEA A3 performance properties under standard ACEA.

Lubricating compound No. 1 includes:

- a lubricating medium consisting of mineral oil, paraffin thickener, isobutene polymer, coloring agent, aromatizer;
- a dehydration product of the hydrates of natural minerals or mixture of natural minerals or synthesized hydrates, where the dehydration product includes the oxides of MgO and SiO2 and Al2O3, obtained after bound water removal and crystal lattice destruction at 750° C., stable phase of the dehydration product is achieved with temperature hold at approx. 1,000° C. for 120 minutes, which ensures obtaining the grain of the decay product, within the range of 50,000-60,000 n.m.

The engine treatment included three stages.

Stage 1. Lubricating compound No. 1 was introduced to the engine oil. Then the automobile was operated in normal operational mode during 150 km of run.

Stage 2. Lubricating compound No. 1 was introduced to the engine oil. Then the automobile was operated in normal operational mode during 150 km of run.

Stage 3. Lubricating compound No. 1 was introduced to the engine oil. Then the automobile was operated in normal operational mode during 1,200 km of run.

The efficiency of lubricating compound No. 1 was estimated by comparing the parameters of the engine operation before and after the treatment: toxicity of exhaust gases, fuel consumption, engine power and compression.

1. Measurement of toxicity of exhaust gases (CO, HC, NOx, CO2) was carried out according to 70/220/EC i. d. F. 2006/96/EC Type I.

Application of lubricating compound No. 1 had positive change in the emissions of carbon oxide, carbon dioxide and hydrocarbon (Table 1). Change of the average value from 1.250 g CO/km to 1.051 g CO/km corresponds to the reduction of the emission of carbon oxide by 15.92%. Change of the average value from 173.247 g CO2/km to 164.319 g CO2/km corresponds to the reduction of the emission of carbon dioxide by 5.16%. Change of the average value from 0.118 g HC/km to 0.109 g HC/km corresponds to the reduction of the emission of hydrocarbon by 7.63%. Reduction of the emission of nitrogen oxide was not observed during the tests.

TABLE 1

Comparison of averaged toxicity indices before and after the application of lubricating compound No. 1

| o. | Toxicity index | Value before treatment, g/km | Value after treatment, g/km |
|---|---|---|---|
| | Average value CO | 1.25 | 1.051 |
| | Average value $CO_2$ | 173 | 164 |
| | Average value HC | 0.118 | 0.109 |
| | Average value $NO_x$ | 0.084 | 0.087 |

2. Calculation of the fuel consumption was carried out according to 80/1268/EC i. d. F. 2004/3/EC. As a result of the lubricating compound No. 1 application the reduction of fuel consumption was determined through comparative analysis. (Table 2). Change of the average value from 7.351 1/100 km to 6.962 1/100 km corresponds to the reduction of fuel consumption by 5.29%.

TABLE 2

Comparison of average fuel consumption indices before and after the application of lubricating compound No. 1

| o. | Index | Value before treatment, 1/100 km | Value after treatment, 1/100 km |
|---|---|---|---|
| | Average fuel consumption value | 7.351 | 6.962 |

3. The measurement of the engine power was carried out according to 80/1269/EC i. d. F. 1999/99/EC. As a result of the lubricating compound No. 1 application increase of the engine power was determined (Table 3). Change of the engine power from 85.6 kW to 87.9 kW corresponds to the increase by 2.68% or 2.3 kW.

TABLE 3

Comparison of average indices of engine power before and after the application of lubricating compound No. 1.

| o. | Index | Value before treatment | Value after treatment |
|---|---|---|---|
| | Engine power, kW | 85.6 | 87.9 |

4. Compression was identified using a data recorder for compression determination. The lubricating compound No. 1 application increases engine compression (Table 4). Based on the initial measurements before the lubricating compound No. 1 application the compression pressure was uneven, deviations of some cylinders were up to 2 atmospheres. After the lubricating compound No. 1 application the compression pressure became even. Compression deviations pressure in individual cylinders became insignificant. Furthermore, considerable compression pressure increase was observed in cylinders 2 and 3.

TABLE 4

Average indices of engine compression in individual cylinders before and after the application of lubricating compound No. 1.

| Cylinder No. | Compression value before treatment, Bar | Compression value after treatment, Bar |
|---|---|---|
| 1 | 12.6 | 14.1 |
| 2 | 9.6 | 14.1 |
| 3 | 9.3 | 14.4 |
| 4 | 11.6 | 14.5 |

The efficiency estimation of lubricating compound No. 1 according to the following parameters: exhaust gases toxicity decrease (CO2, CO, HC), fuel consumption reduction, engine power and compression increase gave positive results.

An Example of Obtaining and Application of Lubricating Compound No. 2.

Lubricating compound No. 2 was applied for treatment of the petrol engine with the power of 55 kW of automobile VAZ 2121 1.6 (Niva), manufactured in 1995, with 320,467 km. of run, after the major repairs 12,336 km, engine oil with viscosity SAE 15W-40 under standard SAE J300 and the level of operational features CCMC G4 under standard CCMC.

Lubricating compound No. 2 includes:

- a lubricating medium consisting of mineral oil, paraffin thickener, isobutene polymer, coloring agent, aromatizer;
- a dehydration product of the hydrates of natural minerals or a mixture of natural minerals or synthesized hydrates, where the dehydration product includes the oxides of SiO2 and Al2O3 and CaO, obtained after bound water removal and the crystal lattice destruction at 800° C., stable phase of the dehydration product is achieved with temperature hold at approx. 1,050° C. for 150 minutes, which ensures obtaining the grain of the decay product, within the range of 70,000-90,000 n.m.

Treatment was carried out in three stages.

Stage 1. Lubricating compound No. 2 was introduced to the engine oil. Then the automobile was operated in normal operational mode during 240 km of run.

Stage 2. Lubricating compound No. 2 was introduced to the engine oil. Then the automobile was operated in normal operational mode during 270 km of run.

Stage 3. Lubricating compound No. 2 was introduced to the engine oil. Then the automobile was operated in normal operational mode during 2,500 km of run The efficiency of lubricating compound No. 2 was estimated by comparing the parameters of the engine operation before and after the treatment: fuel consumption, engine power and compression.

After the lubricating compound No. 2 application engine power increased by 2.68%, fuel consumption reduced by 5.29%, average cylinder compression rate increased from 9.5 to 13 atmospheres.

The efficiency estimation of lubricating compound No. 2 according to the following parameters: fuel consumption reduction, engine power and compression increase gave positive results.

An Example of Obtaining and Application of the Lubricating Compound No. 3.

Lubricating compound No. 3 was applied for the treatment of diesel engine K6S310DR (manufactured by ČKD NM, Czech Republic) with the power of 993 kW of diesel-locomotive shunter ChME Z No.4042, manufactured in 1982, engine oil M14 B2 State Standard GOST 12337-84.

Lubricating compound No. 3 includes

- a lubricating medium consisting of mineral oil, paraffin thickener, isobutene polymer, coloring agent, aromatizer;
- a dehydration product of the hydrates of natural minerals or a mixture of natural minerals or synthesized hydrates, where the dehydration product includes the oxides of MgO and SiO2 and Al2O3 and Fe2O3, obtained after bound water removal and crystal lattice destruction at 850° C., stable phase of the dehydration product is achieved with temperature hold at approx. 1,150° C. for 170 minutes, which ensures obtaining the grain of the decay product, within the range of 60,000-80,000 n.m.

Treatment was carried out in three stages.

Stage 1. Lubricating compound No. 3 was introduced to the engine oil. Then the diesel-locomotive shunter was operated in normal operational mode during 10 machine hours.

Stage 2. Lubricating compound No. 3 was introduced to the engine oil. Then the diesel-locomotive shunter was operated in normal operational mode during 9 machine hours.

Stage 3. Lubricating compound No. 3 was introduced to the engine oil. Then the diesel-locomotive shunter was operated in normal operational mode during 1,600 machine hours.

The efficiency of lubricating compound No. 3 was estimated by comparing the parameters of the locomotive engine operation before and after the treatment: compression, combustion pressure, vibration level (vibration velocity and displacement) in check points.

After the lubricating compound No. 3 application engine power increased by 2.68%, fuel consumption decreased by 5.29%, average cylinder compression rate increased from 26.5 to 30 atmospheres, average compression pressure of cylinders increased from 33.5 to 38 atmospheres, vibration level in check points decreased by 18-56%.

The efficiency estimation of lubricating compound No. 3 by the following parameters: compression and combustion pressure increase and vibration level decrease gave positive results.

An Example of Obtaining and Application of Lubricating Compound No. 4.

Lubricating compound No. 4 was applied for the treatment to treat single-stage reversed gearbox of 2TSO-22 skip hoist loader, oil I-40a State Standard GOST 20799, average gearbox life between replacements is 4-5 months.

Lubricating compound No. 4 includes:

- a lubricating medium consisting of mineral oil, paraffin thickener, isobutene polymer, coloring agent, aromatizer;
- a dehydration product of the hydrates of natural minerals or a mixture of natural minerals or synthesized hydrates, where the dehydration product includes the oxides of MgO and SiO2 and Al2O3 and K2O and Na2O, obtained after bound water removal and crystal lattice destruction at 600° C., stable phase of the dehydration product is achieved with temperature hold at approx. 1,000° C. for 80 minutes, which ensures obtaining the grain of the decay product, within the range of 80,000-95,000 n.m.

Treatment was carried out in three stages.

Stage 1. Lubricating compound No. 4 was introduced to the gearbox oil. Then the gearbox was operated in normal operational mode during 10 hours.

Stage 2. Lubricating compound No. 4 was introduced to the gearbox oil. Then the reducer was operated in normal operational mode during 11 hours.

Stage 3. Lubricating compound No. 4 was introduced to the gearbox oil. Then the gearbox was operated in normal operational mode during 400 hours.

The efficiency of lubricating compound No. 4 was estimated through the parameters comparison before and after the treatment: time between overhauls, state of contacting surfaces, thickness of gear teeth and gearwheel, consumed power under the fixed load at the output gearbox shaft, vibration level in bearing supports.

After the lubricating compound No. 4 application:

- unevenness of tooth thickness decreases up to 0.2-0.3 mm.
- gear teeth and gearwheel thickness increases up to 0.2-0.5 mm in the places of the highest wear.
- surface defects on tooth bearings are partially removed;
- noise level under load is reduced;
- vibration on bearing supports decreased by 35-60%;
- power consumption decreased by 11%;
- service life comprises 15 months.

The efficiency estimation of lubricating compound No. 4 by the above parameters gave positive results.

The lubricating compound, obtained under the proposed method, is based on the revitalizant nanostructure, which was received from dehydration products of natural and/or synthesized hydrates and/or their mixtures, at the temperatures of bound water removal and temperatures of the dehydration product stabilization, being within the range of 300-1,200° C., which in its stable state contains oxides of MgO and/or SiO2 and/or Al2O3 and/or CaO and/or Fe2O3 and/or K2O and/or Na2O, including nanograin and the binding phase; therewith nanoformations have amorphous pomegranate-like form. The size of the form ranges 100-100,000 n.m. at the size of nanograin ranging from 2 to 2,000 n.m., and obtaining the stable form of the revitalizant nanoformations includes dehydration of natural and/or synthesized hydrates and/or their mixtures, at the temperatures of bound water removal up to 900° C., dehydration product stabilization at the temperatures from 700 to 1,200° C. over 1-3 hours, mixing the obtained product with the lubricating medium, where the above oxides were selected from the groups that include MgO and/or SiO2 and/or Al2O3 and/or CaO and/or Fe2O3 and/or K2O and/or Na2O, feeding prepared mixture to the friction surface to the friction area; at the same time the stable form of the revitalizant nanostructure, whose size ranges from 100 to 100,000 n.m. and transits to the stable rolling form depending on the specific pressure on the friction surface and the temperature in the friction area; therewith, the time of transition to the stable rolling form of the revitalizant nanoformations depends on the roughness of the treated surface and the level of the friction unit wear.

Technical effect of the proposed technical solution is in the fact that under the interaction between the revitalizant lubricating compound and the friction surface or restoration surface the top layer saturates with carbon further forming carbides, which, consequently, leads to the surface strengthening with the revitalizant nanostructures, which is accompanied not only by cementation (carbidization) of the surface but also by the following nanophenomenon.

The specific feature of this strengthening is in the formation of direct stresses along the depth of the modified layer. Traditional surface plastic deformation of parts is performed using shot, steel balls, rolling etc. Such mechanical strengthening creates residual compressing (positive) stresses in the surface layer of parts, increasing the fatigue strength endurance, improving the surface hardness, reducing its roughness, removing surface microdefects.

The lubricating compound proposed under this technical solution and its preparation method, is a part of XADO technology, which is applied by XADO company (Kharkiv, Ukraine).

The process cycle of XADO technology consists of several restorative stages. As a result of the stages application nanoparticles of the revitalizant lubricating compound (which are not abrasive in this case) serve as deformation-strengthening elements. Considerable compression stresses formation in the surface layer is also confirmed with the data of X-ray strain metering (sin 2ψ method). At the same time, the effects of surface strengthening by the application of the revitalizant lubricating compound transfers to nanolevel. As a result compression stresses, which may be obtained only by « shot »' treatment occur here due to the « nanoshot »', which is not abrasive and is present in the lubricant over the whole period of revitalization. Interaction of the revitalizant lubricating compound particle under P,T factors (high specific pressures and temperatures) deforms the part surface. Therewith, it strengthens and smoothens the part surface; its roughness decreases to nanolevel.

The practical use of the lubricating compound and its preparation method are described below. The revitalizant nanostructure and products, which contain revitalizant, modifies (changes) the structure of friction surfaces of machines and car parts, thereby providing their restoration, antiwear protection, resource extension and friction loss decrease.

The Authors believe that the essential technical features of the lubricating compound are:

- friction surface strengthening;
- roughness decrease;
- structured coating formation;
- friction coefficient decrease;
- transition of friction pairs into a quasi-no-wear state.

The key technological advantages of the revitalizant lubricating compound application are: in-place repair of the restorable equipment, extension friction surfaces resource, long-term maintaining of technical parameters (strength, roughness) of friction surfaces, energy consumption decrease during the restoration cycle.

XADO technology that involves the claimed lubricating compound, is the leader among the technologies of in-place repair. Restoration of worn mechanism and car parts is performed during their normal operation. Equipment repair with XADO technology application is limited to introduction of the revitalizant to oil (lubricating medium or operational liquid of the mechanism).

The application of XADO technology, as the technology of in-place repairs for the car engine shows at least five-time reduction in the cost of repairs and actually zeros time consumption.

After the XADO technology application and in further operation modified surface layer of the parts transfers into a quasi-no-wear operational state. The practice of the revitalizants application shows that the mechanism resource extends by 2-4 times on average.

For instance, the time until the complete overhaul of the VAZ-family automobiles determined by the manufacturer is, depending on the make, 90-120 thousand km of run. The practice of the XADO technology application in these automobiles shows that depending on the operation conditions, their resource extends by 2-4 times and may reach up to 500 thousand km.

Reduction of friction losses determined by mutual movement of the parts under the boundary and mixed lubrication, after the revitalizant application, is significant and in the laboratory studies reaches 10 times.

Change occurs due to smoothening surfaces (roughness decrease) and the action of revitalizant particles as rolling elements.

Modified surfaces by the lubricating compound application and it preparation method according to XADO technology are very smooth, they acquire appearance of the mirror-like coating. Modified surfaces have very low roughness (indices of nanoroughness Ra up to 60 nm).

According to the proposed technical solution the revitalizant particles at the final stage of the surface modification serve as rolling elements and significantly reduce the friction coefficient.

Provided the revitalizant lubricating compound is applied in the automobile with insignificant wear, the average indices of fuel economy are under the power stroke up to 2-3%, under idle operation—20-30%. In case the revitalizant is applied in the automobile with significant wear, the values of fuel economy are higher due to the elimination of losses, related to the wear of cylinder-piston group (engine efficiency coefficient decrease).

The average maximum energy economy percent by the lubricating compound application and its preparation in XADO technology in industry is 6-12%.

Other important advantages of XADO technology include versatility of its application in various cars and mechanisms, as well as environmental soundness.

The versatility of application is mostly determined by the opportunity of the lubricating compound application and its preparation method in XADO technology for any metal couplings of ferrous and non-ferrous parts regardless of their combinations, lubricated with lubricant (oil, grease, hydraulic liquid, fuel etc.). Thus, the revitalizants application is possible and it is currently applied in all industries: transport (automobile, railway, sea etc.), manufacturing (compressors, engines, gearboxes, hydraulic systems etc.), domestic appliances etc.

Environmental soundness of the lubricating compound and its preparation method in XADO technology is not only in energy saving but also in decrease of exhaust gases toxicity by application in internal combustion engines. Inside clearances, formed in worn engine, are eliminated. The engine restores its parameters of compression, power, and toxicity level of exhaust gases to nominal values.

Undeniable arguments for the XADO technology are application simplicity and fast observable effect. It should also be noted that XADO technology is in fact the one which cannot harm any mechanism. Owing to the self-organization of revitalization phenomenon, the formation of the modified coating continues till achieving the value and structure, under which further friction losses are reduced to minimum, and the mechanism resource, determined by wear, is maximum.

Furthermore, XADO technology has fields of application, in which it is impossible to apply other restoration and life extension methods.

These are, first of all, special equipment,—bores of firearms (automatic guns, machineguns, cannons). At present there are no methods for the restoration of the bore inner surface. Application of the revitalizant lubricating compound allows not only to restore the accuracy, flatness, maximum stopping power parameters of for the worn bore, but also to improve the class of new gun.

The field of application of the lubricating compound and its preparation method in XADO technology also includes fuel equipment of diesel engines, which is as a rule the most expensive part of a diesel engine where precision friction pairs are used. The Authors of the proposed technical solution believe that the application of the revitalizant compound, can restore the plunger and barrel assembly of high-pressure pumps. The revitalizant lubricating compound is added to the fuel and, going through the fuel pump under the engine operation, restores high-precision friction pairs.

There are also other mechanisms, which are not repairable at all, but are subject to wear-out replacement. For instance, constant-velocity joints and bearings. Changing of standard lubricant in these mechanisms on the lubricant with revitalizant allows restoring and even increasing their class during operation and extending their resource by over one and a half time.

Thus, the lubricating compound application and its preparation method in XADO technology have a number of doubtless competitive advantages. The most important among them are: in-place repairs and restoration of units and mechanisms, their resource extension and energy saving.

As described above the proposed technical solution, the lubricating compound based on the revitalizant nanostructure and its preparation method of this lubricating compound, are new, have an inventive step and are applicable in industry.

The invention claimed is:

1. A lubricating composition comprising:

a lubricating medium; and a dehydration product of natural mineral hydrates, natural mineral composition, or synthesized hydrates in which the dehydration product includes at least one of the oxides MgO, $SiO_2$, $Al_2O_3$, CaO, $Fe_2O_3$, $K_20$, and $Na_2O$ and has been obtained after constitution water elimination and crystal lattice destruction at a temperature from 350° C. to 900° C.;

wherein the dehydration product has been obtained after constitution water elimination and crystal lattice destruction at a temperature not higher than 900° C. and wherein the dehydration product reaches at least one of a stable permanent stage at a temperature exposure over the range of 900° C.-1200° C. for 1-3 hours, wherein an obtained stable, amorphous, pomegranate-like nanostructure of the dehydration product, the pomegranate-like nanostructure comprising a nanostructure and a plurality of nanograins, the nanostructure having a size in the range of about 100 nm to about 100000 nm, the plurality of nanograins having sizes in the range of about 2 nm to about 2000 nm.

2. A method of preparing a lubricating composition, comprising:

dehydrating at least one of metal oxides hydrates and nonmetals at the temperature from 350° C. to 900° C., wherein the stated oxides are at least one of MgO, $SiO_2$, $Al_2O_3$, CaO, $Fe_2O_3$, $K_20$, and $Na_2O$;

blending an obtained dehydration product with a lubricating medium; and following the dehydrating step, and prior to the blending step, stabilizing the dehydration product at concerted temperature exposure from 900° C. to 1200° C. and for a retention interval of 1-3 hours.

* * * * *